United States Patent [19]

Nawrath

[11] Patent Number: 4,676,159

[45] Date of Patent: Jun. 30, 1987

[54] WEB PRINTING MACHINE WITH INTEGRATED TORN PAPER CUTTER

[75] Inventor: Nikolaus Nawrath, Igenhausen, Fed. Rep. of Germany

[73] Assignee: M.A.N.-Roland Druckmaschinen Aktiengesellschaft, Offenbach am Main, Fed. Rep. of Germany

[21] Appl. No.: 813,621

[22] Filed: Dec. 26, 1985

[30] Foreign Application Priority Data

Jan. 11, 1985 [DE] Fed. Rep. of Germany ..... 3500719

[51] Int. Cl.[4] ..... B41F 13/60

[52] U.S. Cl. ..... 101/226

[58] Field of Search ..... 101/224, 226, 227, 180; 83/370, 360, 575, 469; 250/562, 572; 356/430

[56] References Cited

U.S. PATENT DOCUMENTS

| | | | |
|---|---|---|---|
| 837,633 | 12/1906 | McAnulty | 101/224 |
| 2,125,443 | 8/1938 | Helsel | 101/227 |
| 2,653,536 | 9/1953 | Cooksey . | |

FOREIGN PATENT DOCUMENTS

| | | |
|---|---|---|
| 2844750 | 4/1979 | Fed. Rep. of Germany . |
| 157403 | 11/1982 | Fed. Rep. of Germany . |

OTHER PUBLICATIONS

Wochenblatt fur die Papierfabrikation 2, 1969, S.48=Weekly For Paper Manufacture, vol. 2, 1969, p. 48, Article by Dietrich Nebel.

*Primary Examiner*—J. Reed Fisher

*Attorney, Agent, or Firm*—Frishauf, Holtz, Goodman & Woodward

[57] ABSTRACT

To eliminate space requirements of an additional separating device to cut a torn web of paper in a rotary printing machine, a paper cutter is integrated into the circumference of a guide or transport roller (1) in the form of a knife (12) smoothly merging with the circumference (2) of the roller (1), but pivotable outwardly of the circumference (compare FIGS. 2 and 3) if a "torn paper" condition is sensed. In normal operation, a cam (6) rotates with the roller (1) being carried along, for example by friction, by a stub shaft (4). Upon sensing a "torn paper" condition, an electromagnet (20) pulls a latch (17) in engagement with a ratchet stop (16) on the cam, inhibiting rotation of the cam with the roller (1) and causing a cam follower (8) to rise on a land (7) of the cam, thereby pivoting the knife out of circumferential position with respect to the roller and severing the paper web (5).

12 Claims, 3 Drawing Figures

WEB PRINTING MACHINE WITH INTEGRATED TORN PAPER CUTTER

Reference to related patent, the disclosure of which is hereby incorporated by reference: U.S. Pat. No. 2,653,536. (see specifically FIGS. 12–15 and associated specification).

The present invention relates to a rotary printing machine of the web printing type, typically for long paper webs, and more particularly to a separating device to cut a paper web which, upon its course through the printing machine, became damaged, for example by being torn.

BACKGROUND

Rotary printing machines are subject to tearing of the printed web. A paper web, which is passed through the printing machine and becomes torn can damage the machine since the torn web can wind itself about one of the cylinders or rollers of the printing machine. It has been proposed to cut the web, upon sensing a paper tear, by a paper cutter. The referenced U.S. Pat. No. 2,653,536 shows a system in which scissor-like cutters are located in the printing machine, arranged transversely to the running direction of the web. The cutter is operated when a "paper torn" condition is sensed, for example by a suitable and customary sensor. The paper is then severed.

The system is space-consuming and requires additional space within the printing machine. In normal operation, the cutter does not have any function; it is strictly a safety feature.

THE INVENTION

It is an object to provide a separating device to separate a web in a rotary printing machine, for example upon discovery or sensing of a tear in the web which does not require any space in addition to space previously allocated to operating structures of the machine, which is simple, reliable, and safe.

Briefly, the paper cutter is integrated with a roller or cylinder of the printing machine, typically a paper guide or paper transport cylinder which, when it need not cut the paper, can carry out its normal function of guiding and transporting the paper web; upon occurrence of a "torn paper" condition, the paper cutting mechanism integrated with the roller becomes effective to cut the paper.

In accordance with a feature of the invention, a cutter knife blade is located on a portion of the circumference of a guide or transport roller; upon sensing a "torn paper" condition, the knife is moved out from the circumference or periphery of the guide roller, for example by being pivoted outwardly, into exposed position, and thereby engages the web passing over the roller to cut the web.

In accordance with a preferred feature of the invention, the cutter knife is positioned in a recess of the circumference of the guide or transport roller so that, when the knife is in inoperative condition, it forms a portion of the periphery or circumferential wall thereof, being pivoted outwardly, for example by a camming or ratcheting arrangement, which may be operated electromagnetically upon sensing a "torn paper" condition to cut the paper web.

The arrangement has the advantage that no additional space for the cutter apparatus is needed, and the guiding or transporting function of the specific roller in the printing machine is retained; thus, under normal operation of the printing machine, the roller will function as intended to guide and/or transport the paper web; the cutting arrangement forming part of the roller becomes effective only when needed and, when not needed, does not require any additional space. Further, a plurality of such combination guide roller-cutter arrangements can be located in the machine so that the cutting action can be sectionalized, without extending the size of the machine. Existing machines which do not have a paper cutting feature can readily be retrofitted by replacing a standard guide or transport roller by the combination roller-cutter.

DRAWINGS

DETAILED DESCRIPTION

Figure 1:
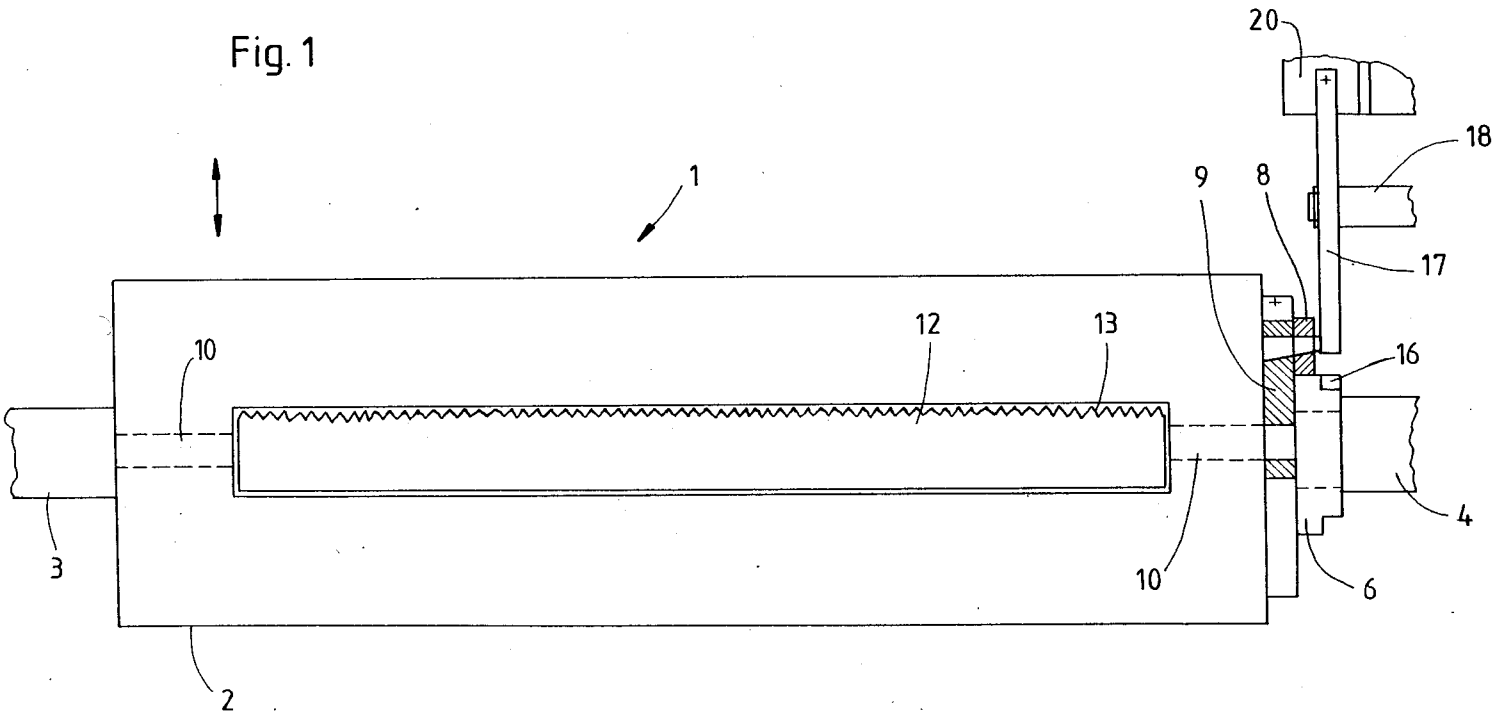
FIG. 1 is a schematic side view, partly in section, of a guide and/or transport roller in a printing machine system.

The paper guide and/or transport roller 1—hereinafter for short merely paper guide roller—includes a freely rotatable cylindrical outer jacket or sleeve 2 which can be driven in any suitable manner, for example by friction with a paper web 5 which is partially looped about the roller 1. The roller 1 is formed with stub shafts 3, 4 which are secured in suitable bearings or journals in side walls of the printing machine—not shown for clarity of the drawing. The position of the roller 1 is determined by its function within the printing machine, for example in a location where the web 5 is to be guided and/or transported, for example if the roller is driven, and, further, at a location which is suitable for severing the web 5 if the web should become torn, thereby preventing damage to the printing machine.

Figure 2:
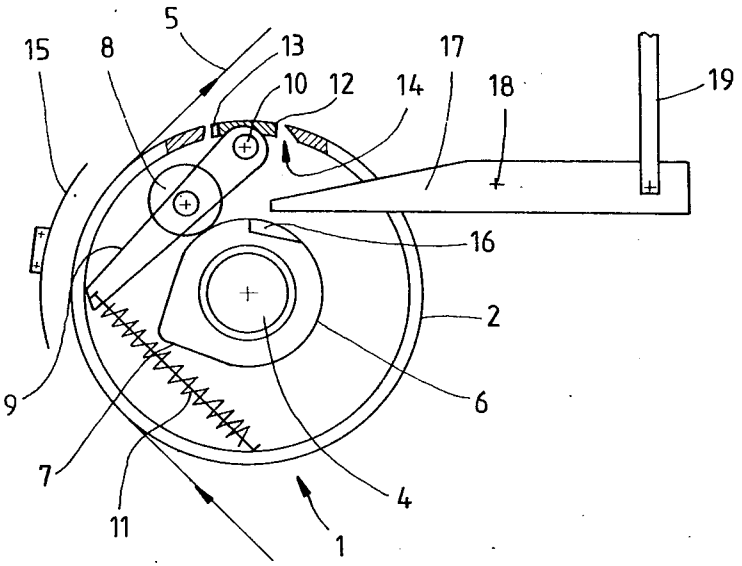
FIG. 2 is an end view, partly in section, of the roller and illustrating the cutting arrangement in inoperative, that is, non-cutting condition.

In accordance with the invention, the cylindrical jacket or circumference 2 of the roller 1 is formed with an axially extending recess in form of a groove 14 into which an elongated separating knife 12 fits which, in normal, that is, non-cutting position (FIG. 2), merges with and matches the cylindrical circumference of the roller 1 to form an essentially smooth circumference with the jacket 2, interrupted only by narrow gaps which permit the knife 12 to move. The outer contour of the jacket or outer wall 2 of the roller 1 thus should be approximately continuously circular, without bumps or extensive interruptions, so that the web guiding and/or transporting function of the roller 1 remains unimpaired when the knife 12 is in the position of FIG. 2.

At least on one facing end, or within the guide roller 1, a control cam 6 is rotatably secured on one or both of the stub shafts, as shown in the drawings, on stub shaft 4 only, although a similar arrangement, forming the mirror image thereof, can be located on the stub shaft 3 as well, and further similar arrangements can be located within the interior of the roller. The cam 6 is formed with a bulge or land in form of a tip or projection 7. A cam follower roller 8 is held in engagement with the cam 6 by a spring 11. The cam follower roller 8 is located approximately in the center of a lever 9. One end of the lever 9 is secured to a bolt 10, the other end of the lever 9 is engaged by the spring 11 which biasses the cam follower roller 8 against the cam of the surface of the cam 6.

The bolt 10 is secured to the inside of the knife 12. The knife 12 is formed at one side, which faces the run-in direction of the web 5, preferably, with teeth 13 (FIG. 1). The cam 6 is additionally formed with a ratchet tooth-like recess 16, positioned for engagement by a lever 17 which is pivotable about a pivot 18. The lever 17 is pivoted by a connecting link 19 which, in turn, is coupled to or forms a plunger armature of a solenoid 20, electrically controlled by a "torn paper" sensor, which may be of any suitable and well known construction.

OPERATION

Figure 3:
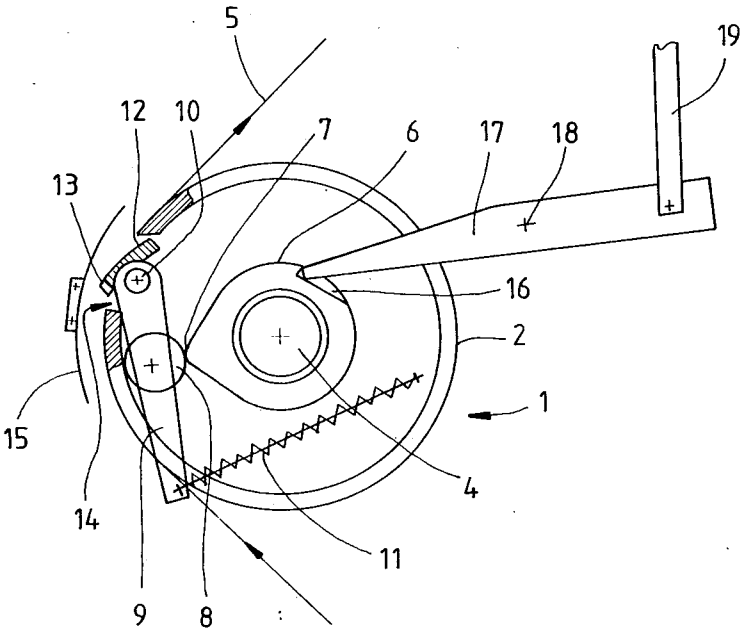
FIG. 3 is a view similar to FIG. 2, illustrating the position of the cutter when the paper is being cut.

In normal operation, the roller 1 can carry out its normal function as a transport or guide roller for the web 5. If, however, a "torn web" sensor indicates that the web 5 is torn, resulting in an electrical signal being applied to the solenoid 20, the position of the knife is changed by pivoting it outwardly from the contour of the roller 2 into the position shown in FIG. 3, in which the corrugated cutting teeth 13 will be facing the web 5.

The pivoting operation of the knife 12 from the contour of the roller 2 is carried out by the interaction of the cams and the ratchet link. A cover 15 is located over the position of the roller when the knife is projected. The position of the protective hook 15 is so chosen that it will always cover the cutter teeth 13 when they could be in projected position.

In normal operation, cam 6 and hence the tip or land 7 rotate together with the jacket 2 of the roller 1. Consequently, lever 9, spring 11 and the roller 8 rotate with the jacket 2 and the circumferential surface of the roller 1 will be essentially continuous. Upon detection of a "torn paper" condition, and energization of the solenoid 20, link 19 is pulled upwardly. The lever 17 will thus engage the recess 16 in the cam 6 in form of a ratchet or latch and lock the cam 6 against further rotation with the roller 1. Since the position of the link 17 is fixed, the position of the roller 1, when the knife is projected, will also be determined, that is, beneath the protective shroud 15. Upon engagement of the latch or ratchet link 17 in the recess 16, the cam 6 can no longer rotate with the roller, so that now only the jacket 2, and with it the knife 12 as well as the lever 9, spring 11 and roller 8 continue to rotate. As soon as the roller 8 engages the land 7 on the cam—now in a fixed position—the lever 9 will pivot about the axis of the bolt 10, rotating the bolt 10 and hence pivoting the knife 12 from the position shown in FIG. 2 into the position shown in FIG. 3. The bolt 10 can be secured within the roller in any suitable manner, for example by an angularly offset eye.

The pivoting of the knife 12 is carried out by causing the lever 9 to move when the roller 8 is lifted by engagement with the land 7 of the cam 6. In normal operation, the cam 6 and hence the land 7 rotate with the roller 1; upon determination of a web tear, the cam 6, rotating with the roller and carried along, for example, by friction, is blocked by engagement of the lever 17 in the recess 16. Cam 6 can no longer continue to rotate, so that now only the jacket 2 and with it the blade 12 as well as lever 9, spring 11 and roller 8 can rotate. In the position shown in FIG. 3 of the circumference of the roller 1, the knife 12 is pivoted outwardly so that the cutter teeth 13 will be directed against the web to sever the web.

Control of the lever 17, rotatable about a bolt 18, is carried out by a plunger armature or the like, operated, for example, by a lever 19. Activation of the solenoid 20 is controlled by any well known electronic "torn paper" sensor.

As can be seen, the severing arrangement does not require additional space and can be integrated in any roller already present in the printing machine.

Various changes and modifications may be made within the scope of the inventive concept.

I claim:

1. Rotary web printing machine having a web guide roller (1) for guiding a web (5) through a predetermined path in the printing machine in which the web passes over a portion over the circumference of said roller; and a cutter system to sever the web upon detection of a web tear, said cutter system comprising an essentially axially extending recess (14) formed in the circumferential surface of said guide roller (1);

a cutter knife blade (12, 13) located and fitted, with clearance, in said recess and shaped to form a segmental portion of the circumferential surface of said roller to complete, with the circumferential surface of the roller other than said recess, an essentially cylindrical roller surface, said cutter knife blade (12, 13) being movably positioned in the recess to be movable outwardly from a circumferential position, completing said essentially cylindrical roller surface, in the recess to an exposed position, exposing a cutting edge (13) of the cutter knife blade; and a cutter knife moving means (6, 11) coupled to the cutter knife blade to move the cutter knife blade out from the circumferential position in the circumference of the cylindrical roller surface into the exposed position for engagement with the web (5) and severing of the web upon contact of the cutter knife edge with the web.

2. Printing machine according to claim 1, wherein the cutter knife blade is pivotably located within the recess.

3. Printing machine according to claim 1, including retaining means (11) for retaining the cutter knife blade in the recess in the circumferential position;

and wherein the cutter knife blade moving means (6-11) act against a force exerted by said retaining means tending to hold the cutter knife blade in recessed position.

4. Printing machine according to claim 3, wherein the retaining means comprises a spring (11).

5. Printing machine according to claim 1, wherein said cutter knife blade moving means comprises a control cam (6) located on a shaft element (4) of said guide roller (1);

a cam follower lever (9) and a cam follower (8) thereon, engaging said control cam secured to the roller (1) and rotating therewith;

force means (11) maintaining said cam follower (8) in engagement with said control cam;

means (10) coupling the cam follower lever (9) to the cutter knife (12) and positioned for rotation of the cutter knife (12) from the position smoothly merging with the circumference (2) of the roller to the exposed position exposing a knife edge (13) of the cutter knife to cut the web;

a land (7) formed on the control cam (6) and a blocking discontinuity (16) formed on the control cam, movable means (20,19) operable upon sensing a torn paper condition of the web, said movable means being coupled to engage the discontinuity (16) on said control cam and lock the control cam against continued rotation with the shaft element (4) and hence the guide roller so that, upon continued rotation of the cam follower with the guide roller, the cam follower will engage the land on the cam and pivot the knife (12) into paper cutting projecting from the circumference of the roller (2).

6. Printing machine according to claim 5, wherein the movable means comprises an electromagnet (20) and a latch (17) coupled to the electromagnet and selectively engageable with the discontinuity (16) on the control cam (6), the change of energization of the electromagnet, upon sensing of a torn paper condition, causing the latch to engage the discontinuity and hence inhibit continued rotation of the control cam (6) with the guide roller (1).

7. Printing machine according to claim 6, wherein the discontinuity (16) forms a ratchet-like recess and said latch (17) is engageable in the recess.

8. Printing machine according to claim 5, further including a protective shroud or shield (15) positioned outside of the circumference (2) of the roller (1) and located with respect to the circumference of the roller (1) at the position of the knife (12) if the knife is projected out of the circumference of the roller (1) upon engagement of movable means with the discontinuity of the cam (6).

9. Printing machine according to claim 1, wherein the knife is an elongated knife blade (12) extending axially along the roller (1), and having an outer, curved surface smoothly merging with and forming a continuation of the circumference of the roller and covering said recess.

10. Printing machine according to claim 1 wherein the cutter knife moving means (6, 11) comprises electro magnetic means (20) coupled to the movable cutter knife blade (12, 13).

11. Printing machine according to claim 10 further including a protective shroud or shield (15) positioned outside of the circumference (2) of the roller, and located with respect to the circumference of the roller at a predetermined angular position thereof;

and means (6, 16, 17) for sensing when the cutter knife blade is at said predetermined angular position beneath the protective shroud;

and wherein the cutter knife moving means project the cutter knife blade into said exposed position only when the cutter knife blade is in said predetermined angular position and beneath the protective shroud.

12. Printing machine according to claim 10 wherein the cutter knife moving means includes cam and link means coupled to the electro magnetic means and to the cutter knife blade, respectively.

* * * * *